US007608771B2

(12) United States Patent
Fournier et al.

(10) Patent No.: US 7,608,771 B2
(45) Date of Patent: Oct. 27, 2009

(54) SYSTEM FOR THE CONTROLLED HITTING OF A PERCUSSION INSTRUMENT

(76) Inventors: Claude Fournier, 240 Guillaume-Barrette, La Prairie, Québec (CA) J5R 6L7; Paul Seney, 1 Phaneuf, St-Jean-sur-Richelieu, Québec (CA) J2X 5S6

( * ) Notice: Subject to any disclaimer, the term of this patent is extended or adjusted under 35 U.S.C. 154(b) by 0 days.

(21) Appl. No.: 11/849,329

(22) Filed: Sep. 3, 2007

(65) Prior Publication Data

US 2008/0053292 A1 Mar. 6, 2008

(51) Int. Cl.
*G10D 13/02* (2006.01)

(52) U.S. Cl. ..... 84/422.1; 84/104

(58) Field of Classification Search ..... 84/104, 84/422.1

See application file for complete search history.

(56) References Cited

U.S. PATENT DOCUMENTS

| | | | | | |
|---|---|---|---|---|---|
| 769,285 | A | * | 9/1904 | Zandalazini | 84/104 |
| 770,300 | A | * | 9/1904 | Meinel | 84/104 |
| 932,213 | A | * | 8/1909 | Wieser | 84/104 |
| 965,435 | A | * | 7/1910 | Brauer | 84/104 |
| 1,045,357 | A | * | 11/1912 | Anderson | 84/422.1 |
| 1,055,688 | A | * | 3/1913 | Wood | 84/104 |
| 1,085,308 | A | * | 1/1914 | Van Valkenburg | 84/104 |
| 1,110,364 | A | * | 9/1914 | Wiggen | 84/104 |
| 1,281,107 | A | * | 10/1918 | Van Valkenburg | 84/104 |
| 1,379,654 | A | * | 5/1921 | Sommermeyer | 352/20 |
| 1,500,095 | A | * | 7/1924 | Gustafson | 84/6 |
| 1,646,061 | A | * | 10/1927 | Lifshitz | 84/422.1 |
| 1,685,090 | A | * | 9/1928 | Lifshitz | 84/104 |
| 1,688,450 | A | * | 10/1928 | Corbett | 84/3 |
| 1,874,154 | A | * | 8/1932 | Barbieri | 84/170 |
| 2,298,701 | A | * | 10/1942 | Kalish | 310/30 |
| 2,822,717 | A | * | 2/1958 | Slawienski | 84/422.1 |
| 3,290,979 | A | * | 12/1966 | Glass et al. | 84/104 |
| 3,747,464 | A | * | 7/1973 | Russell | 84/422.1 |
| 3,967,523 | A | * | 7/1976 | Currier et al. | 84/422.1 |
| 4,747,333 | A | * | 5/1988 | Hoshino | 84/422.1 |
| 5,270,480 | A | * | 12/1993 | Hikawa | 84/645 |
| 5,446,236 | A | * | 8/1995 | Nakada et al. | 84/102 |

(Continued)

OTHER PUBLICATIONS

Singer et al., "A Large-Scale Networked Robotic Musical Instrument Installation" in Proceedings of the NIME05, Vancouver, BC, pp. 50-55.

*Primary Examiner*—Jeffrey Doneis
*Assistant Examiner*—Robert W Horn
(74) *Attorney, Agent, or Firm*—Agence de Brevets Fournier

(57) ABSTRACT

A system for the controlled hitting of a percussion instrument such as a drum including an implement such as a bass drum pedal is described herein. The system comprises a controller for receiving a signal indicative of a beat and for sending triggering command, and an actuator for coupling to the implement and to the controller for receiving the triggering command from the controller and for causing the implement to move at the beat in response to a triggering command from the controller. According to an illustrative embodiment, the actuator includes a motor coupled to the controller so as to be controlled therefrom and a drive mechanism connected to the motor and to the implement for causing the motor to trigger the implement at the beat in response to the triggering command. The system is connected and controlled by a click through a MIDI connection.

9 Claims, 2 Drawing Sheets

U.S. PATENT DOCUMENTS 5,453,567 A * 9/1995 Brinson ..... 84/104
5,550,319 A * 8/1996 Segan et al. ..... 84/103
5,567,899 A * 10/1996 Hoshino ..... 84/422.1
5,587,545 A * 12/1996 Nakada et al. ..... 84/600
5,591,929 A * 1/1997 Wellman ..... 84/422.1
5,627,333 A * 5/1997 Stahnke et al. ..... 84/462
5,668,332 A * 9/1997 Lombardi ..... 84/422.3
5,789,688 A * 8/1998 Schiano ..... 84/422.1
5,925,838 A * 7/1999 Meng-Suen ..... 84/102
5,990,401 A * 11/1999 Braun et al. ..... 84/422.1
5,994,635 A * 11/1999 Hoshino ..... 84/422.1
6,075,191 A * 6/2000 Scire ..... 84/422.1
6,201,173 B1 * 3/2001 Black ..... 84/422.1
6,307,136 B1 * 10/2001 Sikra et al. ..... 84/422.1
6,822,154 B1 * 11/2004 Thai ..... 84/609
6,838,607 B2 * 1/2005 Elliot et al. ..... 84/422.4
7,361,827 B2 * 4/2008 Sasaki ..... 84/723
7,365,258 B1 * 4/2008 Lombardi ..... 84/422.1
7,411,124 B2 * 8/2008 Muramatsu ..... 84/615
2005/0172784 A1 * 8/2005 Lee ..... 84/422.1
2008/0053292 A1 * 3/2008 Fournier et al. ..... 84/422.1
2008/0196573 A1 * 8/2008 Chang ..... 84/422.1

* cited by examiner

SYSTEM FOR THE CONTROLLED HITTING OF A PERCUSSION INSTRUMENT

CROSS-REFERENCE TO RELATED APPLICATION

This application claims the priority of Canadian Patent Application No. 2,558,857 filed Sep. 6, 2006, the subject of which is incorporated herein by reference.

FIELD

The present invention relates to percussion instruments such as drums and cymbals. More specifically, the present invention relates to a system for the controlled hitting of a percussion instrument.

BACKGROUND

Metronomes have been well-known for many years to help musicians keep the beat. The modern embodiment of the metronome is the click track used by many musicians and which is in the form of a beat, including one or more sound, generated by an electronic rhythm machine or played from a pre-recorded track. This beat can be played through headphones or loud-speakers. The quality of the sounds produced by current rhythm box is such that current click tracks are sometimes used to complement or even replace live drumming.

Paradoxically, even though sampling technologies may be used to generate a drum or percussion sound to make it more realistic, a drummer desiring to use the actual sound of his bass-drum or of one of his tom-toms or cymbals in a click track or to complement his drumming during a drum cession, has to go through the whole process of actually sampling the corresponding drum sound. Moreover, even the best drum sampling may sound odd when played mixed with other drums.

A system allowing automatically and naturally triggering the sound of a drum or of any other percussion instrument is thus desirable.

DETAILED DESCRIPTION

Figure 1:
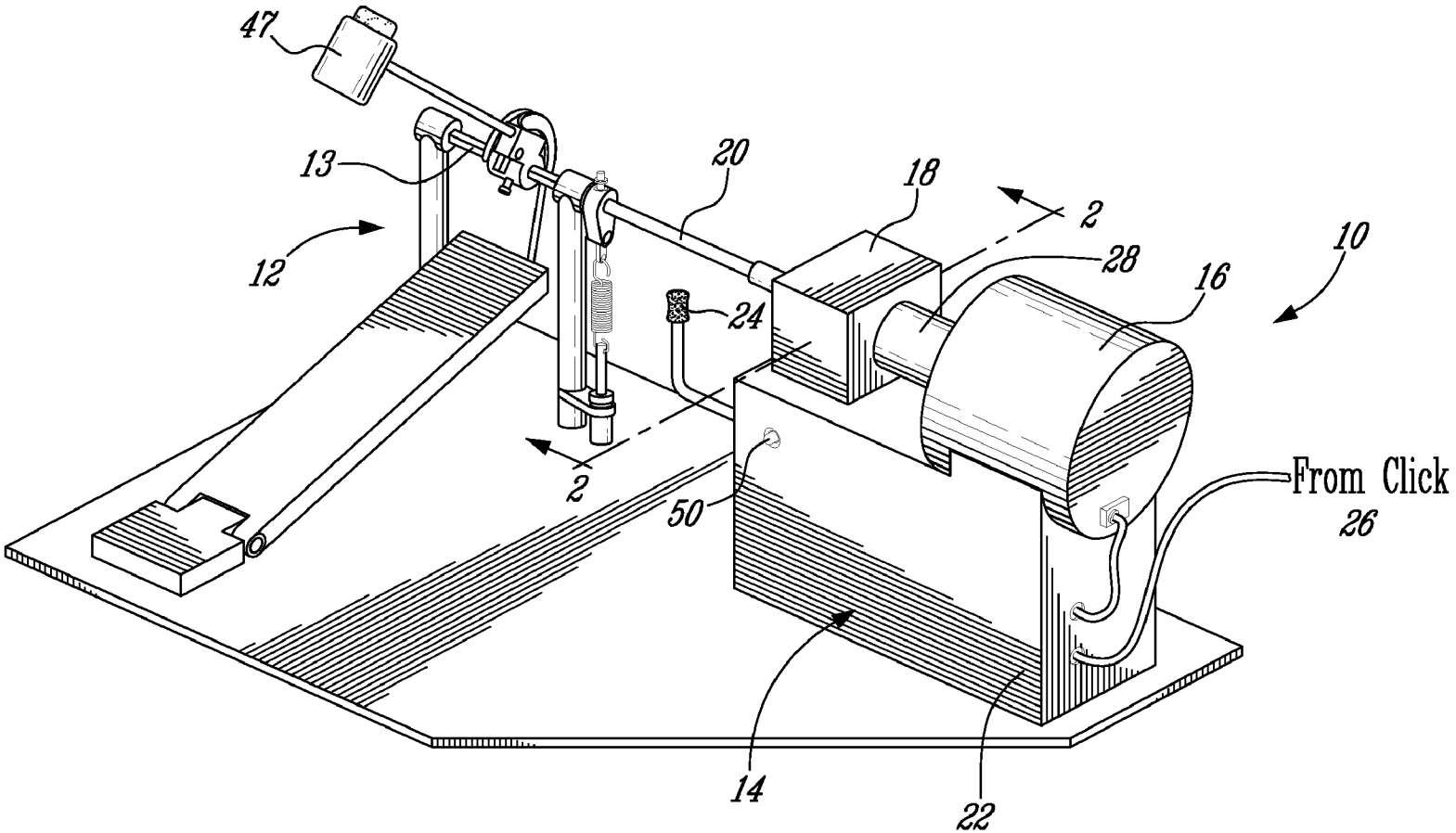
FIG. 1 is a perspective view of a system for the controlled hitting of a bass drum according to a first illustrative embodiment of the present invention; the system being illustrated mounted to a conventional bass drum pedal.

In accordance with the present invention, there is provided a system for the controlled hitting of a percussion instrument including an implement and an object capable of vibrations under controlled action thereon by the implement, the system comprising:

a controller for receiving a signal indicative of a beat and for sending triggering command; and an actuator for coupling to the implement and to the controller for receiving the triggering command from the controller and for causing the implement to move at the beat in response to the triggering command from the controller;

whereby, in operation, bringing the implement in operative relation to the object capable of vibrations for the controlled action thereon while the implement is coupled to and actuated by the actuator, causes the percussion instrument to vibrate at the beat. The system is connected and controlled by a click through a MIDI connection.

Other objects, advantages and features of the present invention will become more apparent upon reading the following non restrictive description of illustrated embodiments thereof, given by way of example only with reference to the accompanying drawings.

Turning now to FIGS. 1 to 5 of the appended drawings a system 10 for the controlled hitting of a percussion instrument according to an illustrative embodiment of the present invention will now be described. The system 10 is adapted for a bass drum (not shown) and more specifically for working with a conventional bass drum pedal 12. However, the system 10 can alternatively be used on a modified or adapted bass drum pedal (not shown).

The system 10 comprises an actuator 14, a controller 22 and an impact detector including a microphone 24 coupled to the controller 22. The actuator 14 includes a motor 16, a drive mechanism 18 for triggering the bass drum pedal 12, and a mechanical coupler 20 for coupling the system 10 and more specifically the drive mechanism 18 with the pedal 12.

As will be described hereinbelow in more detail, the controller 22 receives a signal from a click 26 to actuate the bass drum pedal 12 and sends a triggering signal indicative therefrom to the motor 16. When this occurs, the controller 22 so controls the motor 16 that its shaft 28 actuates the drum pedal 12 via the drive mechanism 18 as will be described hereinbelow.

The drive mechanism 18 will now be described in more detail with reference to FIGS. 2 and 5.

Figure 5:
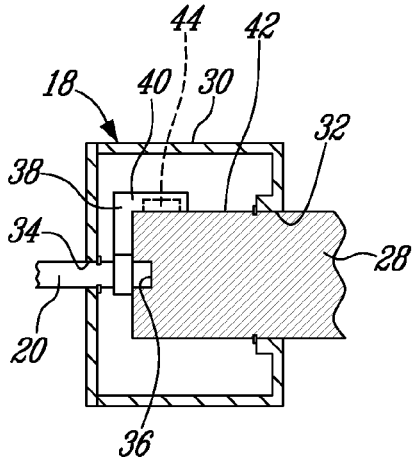
FIG. 5 is a cross-section taken along line 5-5 of FIG. 2.

As can be better seen from FIG. 5, the drive mechanism 18 includes an enclosure 30 provided with a first aperture 32 to allow the shaft 28 therethrough and an opposite aperture 34 to allow the mechanical coupler 20 therethrough. The enclosure is provided mainly to protect the other components of the drive mechanism 18 and to prevent its malfunction which would occur, for example, if an outside object could get jammed therein.

As can also be seen from FIG. 5, the shaft 28 and the coupler 20 are coaxial. More specifically, the shaft 28 includes a central recess 36 in which the coupler 20 is inserted.

A rotating cursor 38 is so mounted to the mechanical coupler 20 as to rotate therewith. The rotating cursor 38 is generally L-shaped so as to have a portion 40 thereof that is in proximity of the peripheral cylindrical surface 42 of the shaft 28.

The shaft 28 of the motor 16 includes a projection 44 in registry with the portion 40 of the cursor 38.

It is to be noted that ball bearings (not shown) or other rotary friction limiting devices (not shown) could be provided between the shaft 28 and the enclosure 30 and/or between the coupler 20 and the enclosure 30 and/or between the coupler 20 and the shaft 28.

Figure 2:
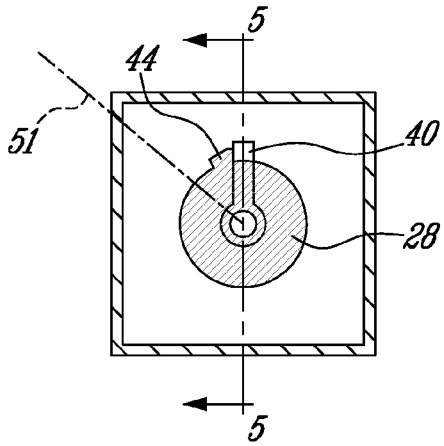
FIG. 2 is a cross-section taken along line 2-2 on FIG. 1, illustrating the drive mechanism in a neutral position.

Turning now to FIG. 2 of the appended drawings, the drive mechanism 18 is shown in a neutral position. When in this position, the projection 44 of the shaft 28 rests against portion 40 of the rotating cursor 38.

Figure 3:
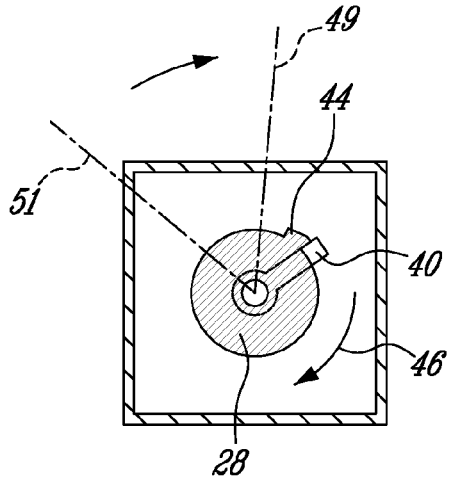
FIG. 3 is a cross-section similar to FIG. 2, illustrating both the shaft and rotating cursor of the drive mechanism in a striking position.

The drive mechanism 18 is shown in a striking position in FIG. 3. To reach the striking position shown in this figure, the motor 16 has been energized to forcefully and quickly rotate the shaft 28 in the direction of arrow 46. This rotation of the shaft 28 causes a radial movement of the projection 44 and thus the radial movement of the portion 40 of the cursor 38 that, simultaneously causes the rotation of the mechanical coupler 20. This rotation actuates the drum pedal 12 causing its beater 47 to hit the drum (not shown). It is to be noted that the position of the beater stick is represented by dashed line 49 in FIGS. 3 and 4, while its neutral position is represented by dashed line 51 in FIGS. 2 to 4.

As it is believed to be well known in the art, the conventional bass drum pedal 12 includes biasing element that biases it towards the neutral position shown in FIGS. 1 and 2. Accordingly, when the shaft 28 returns to the neutral position of FIG. 2, the rotating cursor 38 follows.

Figure 4:
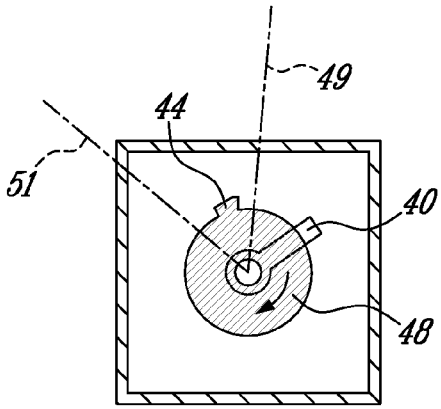
FIG. 4 is a cross-section similar to FIGS. 2 and 3, illustrating the cylinder of the drive mechanism in a neutral position and the rotating cursor in a striking position, corresponding to a drummer by-passing the system 10.

The drive mechanism 18 allows the drummer (not shown) to actuate the bass drum pedal 12 independently. Indeed, as shown in FIG. 4, should the drummer actuates the bass drum pedal 12 during operation of the actuator 14, the rotating cursor 38 would rotate (see arrow 48) along with the coupler 20 to move the portion 40 thereof away from the projection 44 without any interference therefrom so that the bass drum is hit.

Since a click track has to be very precise by definition, the system 10 for the controlled hitting of a percussion instrument is provided with an impact detector allowing to calibrate and adapt the system 10 to the drum and drum pedal to which it is mounted so that the delay between the triggering of the actuator 18 and the actual impact of the beater 47 on the drum is precisely known. Following a calibration for a particular installation, and knowing this triggering delay, the system 10 may inform the click 26 to advance sending triggering signals by a time corresponding to this triggering delay.

The impact detector includes conventional timer electronic circuitry (not shown), a microphone 24 and an actuating switch (not shown), both the microphone 24 and switch being coupled to the timer electronic circuitry.

The calibration process starts by switching on the actuating switch. The calibration process includes the system prompting the user to hit the bass drum. The prompt can take the form for example of a dedicated LED (Light Emitting Diode) 50 illuminating on the casing of the controller 22. Alternatively, the controller 22 can be programmed to send a message to the click 26 to prompt the user via a display screen (not shown) on the click 26. During this step, the microphone 24 records the sound of the bass drum and store the "hit" signature in a memory (not shown) of the controller 22. This signature is indicative of the sound produced by the impact of the beater 47 onto the bass drum and of any surrounding noises. Then, using similar prompting means, the user is warned by the system 10 that it will be actuated to hit the bass drum. A timer of the timer electronic circuitry is simultaneously activated with the actuator 14 and is stopped when a sound recorded by the microphone 24 is recognized from its signature by the controller 22 as having been issued from the bass drum. The time between the stop and start of the timer is stored and later used as being the triggering delay.

The microphone 24 can be replaced by a microphone female socket (not shown) or a microphone XLR socket for example, which allows plugging a removable microphone (not shown).

It is to be noted that the actuating switch can take any form. Also, the impact delay can be computed by a user using an independent timing device and inputted into the click 26. Of course, the click 26 has to be configured accordingly.

In some applications, as will be discussed hereinbelow, or when less precision is required, this calibration process can be omitted.

It is to be noted that, while a microphone 24 is used as an impact sensor, other types of sensors could be used. For example a strain sensor could be associated with the shaft 28 to detect the impact.

In operation of the system 10, after calibration, each time the controller 22 receives a triggering signal from the click 26; it energizes the motor 16 to forcefully and quickly rotate the shaft 28 in a snap movement. This rotation of the shaft 28 causes a radial movement of the projection 44 and thus the radial movement of the portion 40 of the cursor 38 that, simultaneously causes the rotation of the mechanical coupler 20. As it has been explained hereinbelow, this rotation actuates the drum pedal 12 so that its beater 47 hits the drum (not shown).

A person skill in the art would appreciate that different hitting intensities can be achieved by varying for example the torque of the motor 16. These different intensities can be set during the calibration step for example. Different intensities can also be achieved by biasing the beater 47 towards the bass drum prior to triggering the hit. This is achieved, for example, by rotating the shaft 28 from a predetermined angle. A servomotor (not shown) can be included in the actuator 14 for that purposes for example. Pre-determined angles and intensities can be set during a calibration process prior to using the system 10.

Other means to couple the actuator 14 to a bass drum pedal can be provided. These other means can vary, for example, depending on the nature of the actuator 14.

Indeed, other means can be provided to actuate the bass drum pedal 12 in response to a triggering signal from the click 26.

In some applications, for example when the bypass of the bass drum by a drummer is not foreseen, a simpler and/or more direct drive mechanism can be provided.

As an illustrative example, the motor 16 could be a stepper motor.

It is also to be noted that while the system 10 has been shown and described herein in association with a bass drum pedal 12, other hitting implements could be associated therewith. A hi-hat cymbal could be modified to be associated with the drive mechanism 18, for example.

The mechanical configuration of the different elements of the system 10 may vary depending on the configuration of the bass drum pedal to be actuated. The appended figures are for illustrating purpose only.

The present invention is not limited to a system for the control hitting of a bass drum pedal which couples to the rotating shaft 13 of the bass drum pedal 12.

According to the present invention, a system for the controlled hitting of a percussion instrument is not limited to an actuator directly attached to the percussion instrument's implement as will now be illustrated A system for the controlled hitting of a bass drum according to a further illustrative embodiment of the present invention (not shown), comprises an actuator in the form of a solenoid appropriately secured to the floor under the pedal for temporarily attracting the pedal upon receiving the triggering command from a controller, thereby causing its activation. The controller (not shown) is similar to the controller 22 and is responsive to the signal from a click for example. The solenoid is of course positioned relatively to the pedal so as to allow complete action therefrom and also so as to prevent any contact therewith. Similarly to the system 10, such a system can also be bypassed by a drummer without causing any damage thereto. Also, controlling the current in the solenoid, for example via the controller, allows controlling the force of impact and therefore the volume of the stroke.

The present invention is further not limited to a system for the controlled hitting of a bass drum through a bass drum pedal. According to a further embodiment of the present invention, an actuator (not shown) can be used to trigger a small stick pivotably mounted on a tom tom (not shown) so that the stick hits the tom tom skin or rim.

A similar system can also be mounted to a cymbal or to any percussion instrument wherein the implement used is, without limitations, a mallet or a stick for example.

The systems according to the present invention, which have been described more specifically as being mounted to a pedal, can of course be used without further adaptation to a hi-hat.

According to a further illustrative embodiment of the present invention, the actuator 14 is configured for Musical Instrument Digital Interface (MIDI) to allow bi-directional communication with a click controller also configured for MIDI. Since MIDI system and protocol are believed to be well-known in the art, and for concision purposes, they will not be described herein in more detail.

The click 26 can take many forms, including any MIDI controller configured so as to trigger beats. The system 10 can also be used with any other types of clicks provided with an output. The system 10 can be adapted to be actuated by the click's output.

A first application of a system for the controlled hitting of a percussion instrument according to the present invention is to supplement or substitute the drumming of a performer. Indeed, a drummer or any other musician might equip one or a plurality of its tom toms or cymbals, including its hi-hat and bass drum, with such systems connected to one or more click programmed to trigger a desired drum pattern.

According to a second application, an apprentice drummer uses a system for the controlled hitting of a percussion instrument according to the present invention either as a regular click to help him count the beat or as a substitute for one of its limb while he or she can concentrate on the other limb(s).

An apprentice drummer can further use the system 10, provided with a sufficiently powerful actuator 14 and a strap or another foot restraining means on the bass drum pedal, to "feel" a programmed bass drum performance while it is automatically played by the system 10.

A system for the controlled hitting of a percussion instrument according to the present invention can also be used to remotely play a percussion instrument. In such a case, the controller of the system is configured to receive a remote signal indicative of the beat. The controller is then configured for wireless or network communication.

A system for the controlled hitting of a percussion instrument according to the present invention can further be used as a marketing tool to automatically hit a percussion instrument so as to sample its sound in a store or the likes.

Although the present invention has been described hereinabove by way of illustrated embodiments thereof, it can be modified, without departing from the spirit and nature of the subject invention.

The invention claimed is:

1. A system for the controlled hitting of a percussion instrument including an implement and an object capable of vibrations under controlled action thereon by the implement, the system comprising:

a controller for receiving a signal indicative of a beat and for sending a triggering command; and an actuator for coupling to the implement and to the controller for receiving the triggering command from the controller and for causing the implement to move at the beat in response to the triggering command from the controller; the actuator including a motor coupled to the controller so as to be controlled therefrom, a drive mechanism connected to the motor and to the implement for causing the motor to trigger the implement at the beat in response to the triggering command and a mechanical coupler connected to both the drive mechanism and to the implement for coupling the system with the percussion instrument via the implement wherein the mechanical coupler is in the form of a rod to be secured to the implement; the rod including an L-shaped element mounted thereto for rotation in unison; the motor including a drive shaft provided with a projection in registry with the L-shaped element; the mechanical coupler being rotatably mounted coaxially to the drive shaft therein;

whereby, in operation, bringing the implement in operative relation with the object capable of vibrations for the controlled action thereon while the implement is coupled to and actuated by the actuator causes the percussion instrument to vibrate at the beat, and a user pivoting the mechanical coupler results in the implement causing the percussion instrument to vibrate without preventing the rotation of the drive shaft.

2. A system as recited in claim 1, wherein the implement is a bass drum pedal.

3. A system as recited in claim 1, further comprising an impact detector coupled to the controller.

4. A system as recited in claim 3, wherein the impact detector includes timer electronic circuitry, an actuating switch connected to the timer electronic circuitry for actuating the timer electronic circuitry and a sensor coupled to the timer electronic circuitry for detecting the vibrations of the object under controlled action of the implement thereon; the timer electronic circuitry being for determining a triggering delay between the triggering command from the controller and a resulting triggered sound from the percussion instrument, thereby allowing the system to be calibrated for different position of the object capable of vibrations relatively to the implement and to the system.

5. A system as recited in claim 4, wherein the controller further includes a memory for storing a calibration signal indicative of a hit signature sound produced by a user on the percussion instrument; the controller being further configured to compare the resulting triggered sound to the hit signature sound.

6. A system as recited in claim 1, wherein, in the response to the triggering command from the controller, the actuator causes the implement to move at the beat with an intensity set by using the actuator to bias the implement towards the object capable of vibrations at a predetermined position relatively thereof prior to the beat.

7. A system as recited in claim 1, wherein the motor is a stepper motor.

8. A system as recited in claim 1, wherein the controller is configured for wireless or network communication so as to remotely receiving the signal indicative of a beat.

9. A system as recited in claim 1, wherein the object capable of vibrations is a drum or a cymbal.

* * * * *